US009696748B2

(12) United States Patent
Sakai et al.

(10) Patent No.: US 9,696,748 B2
(45) Date of Patent: Jul. 4, 2017

(54) VEHICULAR GRIP STRUCTURE

(71) Applicants: Hideaki Sakai, Toyota (JP); Osamu Miyashita, Toyota (JP); Hiroaki Tsuzuki, Toyota (JP); Tomonori Yanagiya, Toyota (JP)

(72) Inventors: Hideaki Sakai, Toyota (JP); Osamu Miyashita, Toyota (JP); Hiroaki Tsuzuki, Toyota (JP); Tomonori Yanagiya, Toyota (JP)

(73) Assignee: TOYODA IRON WORKS CO., LTD., Toyota (JP)

( * ) Notice: Subject to any disclaimer, the term of this patent is extended or adjusted under 35 U.S.C. 154(b) by 58 days.

(21) Appl. No.: 14/443,832

(22) PCT Filed: Mar. 7, 2013

(86) PCT No.: PCT/JP2013/056373
§ 371 (c)(1),
(2) Date: May 19, 2015

(87) PCT Pub. No.: WO2014/080643
PCT Pub. Date: May 30, 2014

(65) Prior Publication Data

US 2015/0277472 A1 Oct. 1, 2015

(30) Foreign Application Priority Data

Nov. 20, 2012 (JP) ..... 2012-254512

(51) Int. Cl.
*G05G 1/06* (2006.01)
*G05G 1/04* (2006.01)

(52) U.S. Cl.
CPC ..... *G05G 1/06* (2013.01); *G05G 1/04* (2013.01); *Y10T 74/20876* (2015.01)

(58) Field of Classification Search
CPC ..... B60T 7/10; G05G 1/06; B62K 21/26
See application file for complete search history.

(56) References Cited

U.S. PATENT DOCUMENTS 4,881,425 A * 11/1989 Kanno ..... B60T 7/105 74/523
5,110,653 A * 5/1992 Landi ..... A63B 49/08 206/521

FOREIGN PATENT DOCUMENTS

BE CH 264174 A * 9/1949 ..... B62K 21/26
FR 804757 A * 11/1936 ..... B62K 21/26
(Continued)

OTHER PUBLICATIONS

Jun. 11, 2013 International Search Report issued in International Patent Application No. PCT/JP2013/056373.
(Continued)

*Primary Examiner* — Thomas C Diaz
(74) *Attorney, Agent, or Firm* — Oliff PLC

(57) ABSTRACT

A vehicle grip structure including a body member and a grip, in which the body member is covered by the grip made of a synthetic resin, the grip includes an insertion hole in which the body member is inserted and a space portion provided along the insertion hole, multiple elastic protrusions are formed integrally with the grip and dispersedly on one of an inner peripheral-side wall surface and an outer peripheral-side wall surface of the space portion so as to protrude toward the other wall surface, when the grip is held by a driver, the elastic protrusions are pressed against the other wall surface and elastically deformed, and the elastic protrusions are arranged in a grid pattern in which adjoining ones of multiple polygons of the same shape have a common side, and are positioned so as to form each side of the polygons.

5 Claims, 10 Drawing Sheets

(56) References Cited

FOREIGN PATENT DOCUMENTS

| | | | | | |
|---|---|---|---|---|---|
| GB | 348981 | A | * | 5/1931 | ..... B62K 21/26 |
| JP | H05-019038 | U | | 3/1993 | |
| JP | H06-085778 | U | | 12/1994 | |
| JP | 2004-013746 | A | | 1/2004 | |
| JP | 2005-001339 | A | | 1/2005 | |
| JP | 2007-204949 | A | | 8/2007 | |

OTHER PUBLICATIONS

Sep. 29, 2015 Office Action issued in Japanese Patent Application No. 2012-254512.

* cited by examiner

VEHICULAR GRIP STRUCTURE

TECHNICAL FIELD

The present invention relates to vehicle grip structures, and more particularly to vehicle grip structures that provide an excellent feel without reducing material hardness.

BACKGROUND ART

Vehicle grip structures in which a body member is covered by a grip made of a synthetic resin are known in the art. Examples of such vehicle grip structures include holding portions of a parking brake lever, a shift lever, a column shift lever, etc., a grip portion of a door trim, and an assist grip, and Patent Document 1 describes a grip structure in which a grip made of a synthetic resin is mounted on a holding portion of a parking brake lever.

RELATED ART DOCUMENT

Patent Document

Patent Document 1: Japanese Patent Application Publication No. 2004-13746

SUMMARY OF THE INVENTION

Problem to be Solved by the Invention

Such conventional vehicle grip structures provide a soft feel by elasticity of a grip itself. Accordingly, merely reducing material hardness causes reduction in wear resistance, and repeated use may cause deformation or may affect appearance. Particularly at high temperatures, the vehicle grip structures may become sticky due to oozing of a plasticizer etc., which may affect the feel of the vehicle grip structures.

The present invention was developed in view of the above circumstance, and it is an object of the present invention to achieve an excellent feel without reducing material hardness of a grip.

Means for Solving the Problem

To achieve the object, the first aspect of the invention provides a vehicle grip structure in which a body member is covered by a grip made of a synthetic resin, characterized in that (a) the grip includes an insertion hole in which the body member is inserted and a space portion provided along the insertion hole, (b) multiple elastic protrusions are formed integrally with the grip and dispersedly on one of an inner peripheral-side wall surface and an outer peripheral-side wall surface of the space portion so as to protrude toward the other wall surface, and (c) when the grip is held (grasped) by a driver, the elastic protrusions are pressed against the other wall surface and elastically deformed.

The second aspect of the invention provides the vehicle grip structure recited in the first aspect of the invention characterized in that (a) the grip includes a seal member in which at least a part of the insertion hole is formed and which is mounted so as to closely contact the body member, and a surface member that is disposed on an outer periphery of the seal member such that the space portion is formed between the surface member and the seal member, and (b) a retaining claw formed in the body member is retained in a retaining hole formed in the seal member, whereby the grip is integrally mounted on the body member.

The third aspect of the invention provides the vehicle grip structure recited in the second aspect of the invention characterized in, that the grip has an outer cylinder body that is fixedly fitted on a composite body as a combination of the seal member and the surface member by insert-molding, and that keeps the composite body in a combined state.

The fourth aspect of the invention provides the vehicle grip structure recited in the third aspect of the invention characterized in that (a) the composite body has a semi-cylindrical shape, is formed by combining the seal member with the surface member by engaging, in both side portions of the semi-cylindrical shape, protrusions formed on one of the seal member and the surface member with holes formed in the other member, and has the space portion in a curved portion between the side portions, (b) the outer cylinder body has a semi cylindrical portion that together with the semi-cylindrical composite body forms the insertion hole, and a portion on an opposite side of the body member from the composite body is covered by the semi-cylindrical portion.

The fifth aspect of the invention provides the vehicle grip structure recited in the fourth aspect of the invention characterized in that in the composite body, the seal member and the surface member are combined so as to surface contact each other in the side portions.

The sixth aspect of the invention provides the vehicle grip structure recited in the first aspect of the invention characterized in that the grip has a recess in its inner peripheral surface forming the insertion hole, the space portion is formed between the recess and an outer peripheral surface of the body member, the elastic protrusions are formed on a surface of the recess which functions as the outer peripheral-side wall surface, and the elastic protrusions are pressed against the outer peripheral surface of the body member which functions as the inner peripheral-side wall surface and are elastically deformed.

The seventh aspect of the invention provides the vehicle grip structure recited in any one of the first to sixth aspects of the invention characterized in that (a) the body member is a holding portion of a vehicle parking brake lever, and (b) the grip is mounted on the holding portion such that the space portion is located on a vehicle lower side or on a vehicle front side of the holding portion.

Effects of the Invention

In the vehicle grip structure as described above, the space portion is provided along the insertion hole in which the body member is inserted, and the multiple elastic protrusions are dispersedly formed on one of the inner peripheral-side wall surface and the outer peripheral-side wall surface of the space portion. When the grip is held, the elastic protrusions are pressed against the other wall surface and elastically deformed. Accordingly, by appropriately determining the shape such as thickness and height or the arrangement, density, etc. of the elastic protrusions, a soft, excellent feel can be achieved without reducing material hardness of the grip, and reduction in wear resistance, stickiness, etc. can be avoided.

The grip according to the second aspect of the invention has the seal member mounted in close contact with the body member, and the surface member disposed on the outer periphery of the seal member. The retaining claws of the body member are retained in the retaining holes of the seal member, whereby the grip is fixedly fitted on the body member, and the grip is prevented from rotating and coming off. In this case, the seal member can be adapted to various types of body members by merely changing the seal member according to the shape and dimensions of the body member, and the same surface member can be used for various types of body members. This can reduce manufacturing cost.

According to the third aspect of the invention, the outer cylinder body is fixedly fitted on the composite body, which is a combination of the seal member and the surface member, by insert-molding, whereby the composite body is kept in the combined state. The grip can thus be produced at low cost.

According to the fourth aspect of the invention, the use of the composite body having a semi-cylindrical shape ensures excellent workability in setting the composite body on the core of the mold when insert-molding of the outer cylinder body is performed. The composite body is formed by combining the seal member with the surface member by engaging, in both side portions of the semi-cylindrical shape, the protrusions formed on one of the seal member and the surface member with the holes formed in the other member. The seal member can therefore be easily combined with the surface member by flexurally deforming the side portions of the seal member inward or flexurally deforming the side portions of the surface member outward, and the seal member and the surface member are satisfactorily kept in the combined state, namely in the state of the composite body. This improves workability in insert-molding of the outer cylinder body.

According to the fifth aspect of the invention, the seal member and the surface member are combined such that the side portions closely contact the side portions by surface contact. This prevents the molten resin from entering the space portion through a gap between the side portions when insert-molding of the outer cylinder body is performed.

According to the sixth aspect of the invention, the space portion is formed between the recess formed in the inner peripheral surface of the grip and the outer peripheral surface of the body member, the elastic protrusions are formed on the surface of the recess, and the elastic protrusions are pressed against the outer peripheral surface of the body member. The structure is simplified, whereby the grip produced at low cost.

The grip according to the seventh aspect of the invention is mounted on the holding portion of a vehicle parking brake lever such that the space portion is located on a vehicle lower side or on a vehicle front side of the holding portion, namely the side on which fingers of a driver are placed and to which a parking operation force is applied. This can locally improve a feel of a region on which the figures are placed while ensuring the overall rigid feel of the grip.

MODES FOR CARRYING OUT THE INVENTION

Figure 1:
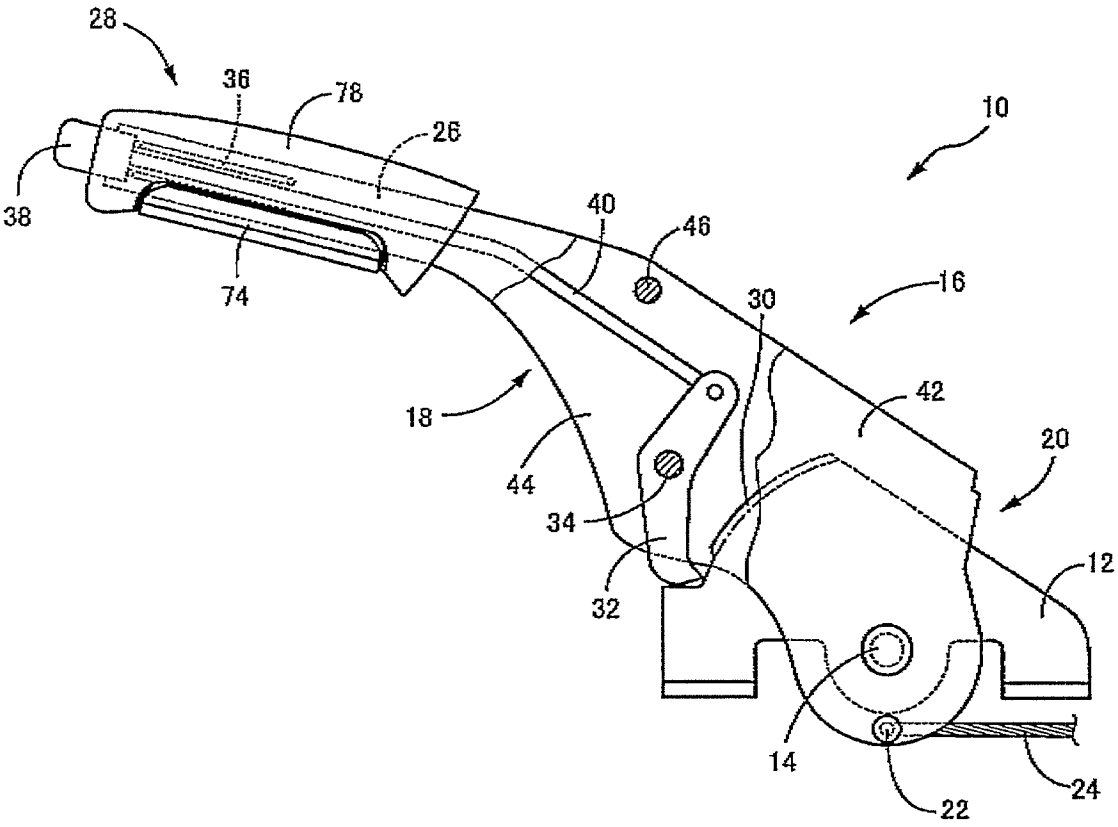
FIG. 1 is a front view in which a vehicle parking brake operation device to which the present invention is applied is shown cutaway.

The present invention is applied to various vehicle grip structures such as holding portions of a parking brake lever, a shift lever, a column shift lever, etc., a grip portion of a door trim, and an assist grip. The body member is made of a relatively rigid material such as a metal, but may be made of a synthetic resin. The insertion hole in which the body member is inserted may be a through hole that opens at both ends. The insertion hole may alternatively be a bottomed hole closed at its one end. Whether the insertion hole is a through hole or a bottomed hole is determined as appropriate according to the body member on which the grip is mounted.

For example, various thermoplastic resins such as polyvinyl chloride and styrene-based, olefin-based, and polyester-based thermoplastic resins are preferably used as the synthetic resin for the grip. The grip includes, e.g., the seal member, the surface member, and the outer cylinder body. However, the grip may be configured in various forms such as a grip formed only by the seal member and the surface member, a grip formed only by the surface member and the outer cylinder body, and a grip formed by a single cylindrical synthetic resin member. In the case where the grip is formed by a plurality of members, the same material (kind of synthetic resin) need not necessarily be used for all the members. Different materials may be used for the members according to their functions. The multiple elastic protrusions may be formed either on the seal member or on the surface member, and the member on which the elastic protrusions are formed is made of a synthetic resin material having predetermined elasticity. The seal member of the second aspect of the invention is made of a soft resin having such a level of elasticity that allows the seal member to be elastically deformed to get over the retaining claw.

For example, the space portion where the multiple elastic protrusions are provided extends substantially parallel to the longitudinal direction of the grip along the insertion hole, and has a substantially arc shape or cylindrical shape in the circumferential direction of the insertion hole. That is, the space portion may either be locally provided in the region on which the fingers are placed as in the seventh aspect of the invention, or be provided along the entire circumference of the body member. For example, the multiple elastic protrusions have a rectangular shape as viewed in plan. However, the elastic protrusions may have various shapes such as a square shape, a circular shape, an elliptical shape, or an arc-like curved shape. The elastic protrusions may have a continuously varying sectional shape as taken along the direction in which the elastic protrusion protrudes, like such a tapered sectional shape that the sectional area decreases toward the tip end. The elastic protrusions may have an asymmetrical shape with respect to the centerline so that the elastic protrusions can easily bend to one side. The multiple elastic protrusions may have the same shape. However, a plurality of types of elastic protrusions having different shapes may be mixed and placed.

In the second aspect of the invention, the retaining claw of the body member is retained in the retaining hole in the seal member in order to prevent rotation and coming-off of the grip. When carrying out other aspects of the invention, however, an engagement recess such as a through hole may be formed in the body member, and an engagement protrusion may be formed in the grip. An engagement protrusion and an engagement recess may be formed in the body member, and an engagement recess and an engagement protrusion may be formed in the grip so as to be engaged with the engagement protrusion and the engagement recess of the body member. The retaining hole may be a through hole extending through the seal member or may be a mere recess. In the case where the body member is made of a metal sheet material, a cut-and-bent claw formed by cutting and bending a part of the metal sheet material is preferably used as the retaining claw. The grip can be mounted on the body member by merely engaging (including retaining) the retaining claw with the retaining hole. However, the grip may be fixedly attached to the body member with an adhesive etc. as necessary.

In the fourth aspect of the invention, the seal member and the surface member have a semi-cylindrical shape. However, a cylindrical seal member and a cylindrical surface member may be used. In the fifth aspect of the invention, the seal member and the surface member surface contact each other in the side portions of the composite body. For example, the contact surfaces of the seal member and the surface member are flat surfaces, but may be curved surfaces having the same curvature etc.

Embodiments

Embodiments of the present invention will be described in detail below with reference to the accompanying drawings.

In FIG. 1, a parking brake operation device 10 includes a sector 12 that is substantially in the shape of a flat plate and that is fixed substantially perpendicularly to a floor of a vehicle body, not shown, a parking brake lever 16 disposed on the sector 12 via a support pin 14 so as to be pivotable about an axis of the support pin 14, etc. The parking brake lever 16 is mainly formed by a lever body 18 made of a metal sheet material. A brake cable 24 is coupled to a base end portion 20 via a coupling pin 22, and a grip 28 made of a synthetic resin is fitted on the outer periphery of a substantially cylindrical distal end portion 26. When the grip 28 is held and pulled up clockwise about the support pin 14 in FIG. 1, the brake cable 24 is tightened, and parking brake for wheels, not shown, is operated. The distal end portion 26 corresponds to a bolding portion.

A ratchet 30 is provided along the arc shape of the sector 12 about the support pin 14, and a pawl 32 that engages with the ratchet 30 is disposed on the parking brake lever 16 so as to be pivotable about a pin 34 parallel to the support pin 14. An insertion hole 29 (see FIG. 3) is formed in a distal end of the cylindrical grip 28, and a release knob 38 is disposed in the insertion hole 29 such that the release knob 38 can be depressed against biasing force of a return spring 36. A release rod 40 is integrally coupled to the release knob 38. The return spring 36 is a compression coil spring and biases the release knob 38 and the release rod 40 in the direction in which the release knob 38 protrudes from the grip 28, namely leftward in FIG. 1. The other end of the release rod 40 is coupled to the pawl 32 so as to be relatively pivotable about an axis parallel to the pin 34. The pawl 32 is subjected to a pivoting force in the counterclockwise direction in FIG. 1 based on the biasing force of the return spring 36 and thus engages with the ratchet 30. The dimension by which the release knob 38 protrudes from the grip 28 is defined by the pawl 32 contacting the sector 12.

The lever body 18 of the parking brake operation device 10 is formed by a pair of body halves 42, 44 as halves of the lever body 18 divided along a dividing plane substantially perpendicular to the axis of the support pin 14, namely a plane parallel to the plane of the paper of FIG. 1. By clinching a coupling pin 46 in addition to the support pin 14 and the pin 34, the pair of body halves 42, 44 are integrally coupled together with the sector 12 and the pawl 32 interposed therebetween, so that the pair of body halves 42, 44 can integrally pivot about the axis of the support pin 14. Those portions of the pair of body halves 42, 44 which form the distal end portion 26 have a substantially semi-cylindrical shape. These semi-cylindrical portions are disposed so as to face each other with their both side portions abutting on each other. The semi-cylindrical portions thus form a cylindrical shape.

Figure 2:
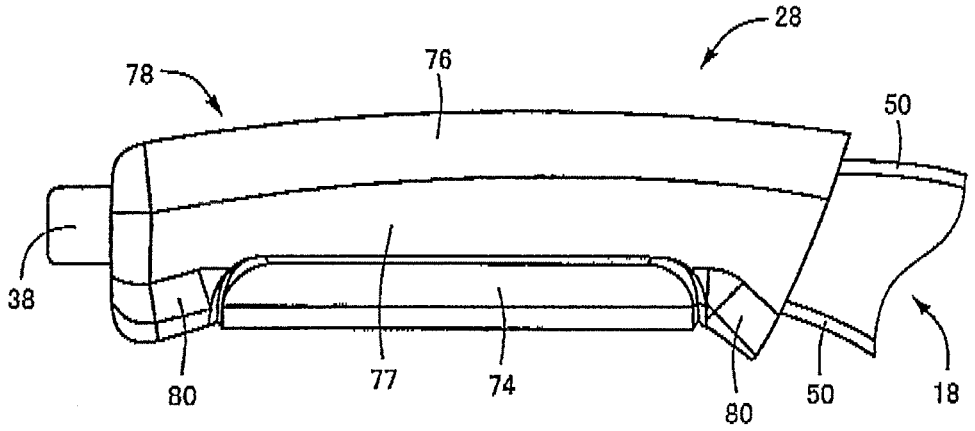
FIG. 2 is an enlarged front view showing a distal end portion of the parking brake lever of FIG. 1, namely a portion having a grip mounted thereon.
Figure 3:
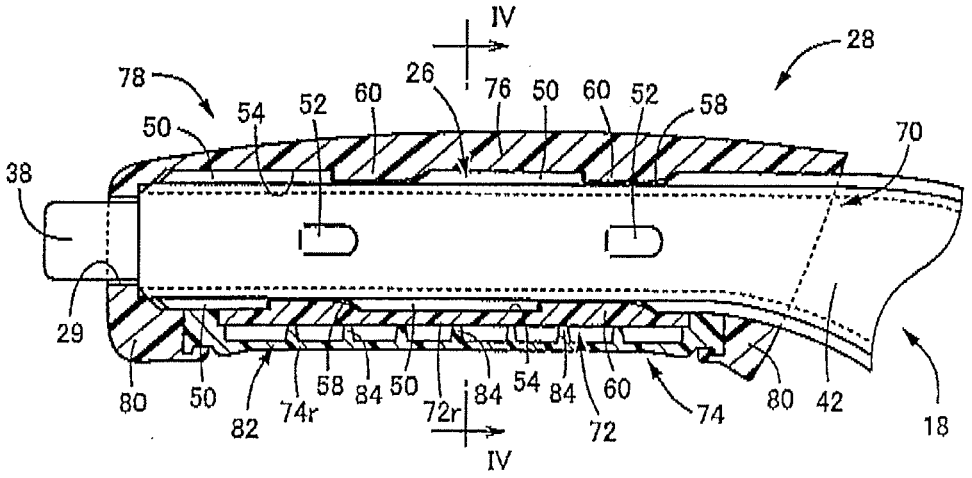
FIG. 3 is a front view in which the grip is shown cutaway in FIG. 2.
Figure 4:
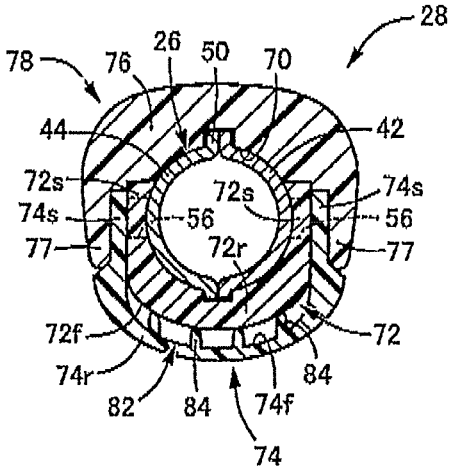
FIG. 4 is a sectional view taken along line IV-IV in FIG. 3.

FIG. 2 is a front view showing a distal end portion of the parking brake lever 16, namely a portion having the grip 28 mounted thereon. FIG. 3 is a front view in which the grip 28 is shown cutaway. FIG. 4 is a sectional view taken along line IV-IV in FIG. 3. The release rod 40 and the return spring 36 are not shown in FIG. 4. In these figures, the cylindrical distal end portion 26 of the lever body 18 has flanges 50 and cut-and-bent claws 52 as a plurality of engagement protrusions protruding radially outward, and an inner peripheral surface of the grip 28, namely an inner peripheral surface of an insertion hole 70 in which the distal end portion 26 is inserted, has engagement grooves 54 and retaining holes 56 as a plurality of engagement recesses.

The flange 50 is provided in both side portions of each of the body halves 42, 44 so as to protrude outward. These flanges 50 are put together and closely contact each other so as to protrude from the upper and lower sides of the distal end portion 26 by a predetermined dimension, and are divided into a plurality of portions in the longitudinal direction by cutouts 58. The engagement grooves 54 are formed at two positions in each of the upper and lower parts of the grip 28 so as to correspond to the flanges 50, and protruding portions 60 are formed in the regions of the grip 28 which correspond to the cutouts 58. When the grip 28 is relatively moved substantially straight from the distal end side of the lever body 18, namely from the left side in FIG. 3, toward the distal end portion 26 and is fitted onto the outer periphery of the distal end portion 26, the grip 28 is elastically deformed and the protruding portions 60 serving as rear ends of the engagement grooves 54 get over the flanges 50 in the longitudinal direction to fit in the cutouts 58, and the flanges 50 fit in the engagement grooves 54. This engagement prevents rotation of the grip 28. Moreover, engagement of the protruding portions 60 with the rear ends of the flanges 50 prevents coming off of the grip 28. Front ends of the flanges 50, namely ends located on the distal end side of the lever body 18, are tilted, and the rear ends of the protruding portions 60 are also tilted. This tilt of the front ends of the flanges 50 and the rear ends of the protruding portions 60 allows the protruding portions 60 to easily get on the flanges 50 to elastically deform the grip 28. The rear ends of the flanges 50 and the front ends of the protruding portions 60 which engage with each other are substantially perpendicular to an axis of the distal end portion 26. This can more reliably prevent the grip 28 from coming off due to the protruding portions 60 getting on the flanges 50.

The rear ends and the front ends are named based on the direction in which the grip 28 is fitted onto the distal end portion 26 of the lever body 18. The rear ends are the ends located on the right side in FIG. 3, and the front ends are the ends located on the left side in FIG. 3.

The cut-and-bent claws 52 are formed at intermediate positions (centers) in the circumferential direction of the body halves 42, 44 so as to protrude more outward as the cut-and-bent claws 52 extend toward the base end portion 20 of the lever body 18. Each of the body halves 42, 44 has a plurality of (in the embodiment, two) the cut-and-bent claws 52 formed so as to be separated from each other in the axial direction of the cylindrical distal end portion 26, and the two retaining holes 56 corresponding to the cut-and-bent claws 52 are formed at two positions in each of both side portions of the grip 28 so as to be separated from each other in the axial direction (see FIG. 8). When the grip 28 is relatively moved substantially straight from the distal end side of the lever body 18, namely from the left side in FIG. 3, toward the distal end portion 26 and is fitted onto the outer periphery of the distal end portion 26, the grip 28 is elastically deformed so that the rear ends of the retaining holes 56 get over the cut-and-bent claws 52 and the cut-and-bent claws 52 are accommodated in the retaining holes 56. This engagement between the retaining holes 56 and the cut-and-bent claws 52 prevents rotation with respect to and coming off from the grip 28. The cut-and-bent claws 52 are tilted so as to protrude more radially outward as the cut-and-bent claws 52 extend toward the rear side in the direction in which the grip 28 is fitted, namely as the cut-and-bent claws 52 extend toward the base end portion 20 of the lever body 18. This tilt of the cut-and-bent claws 52 allows the grip 28 to be easily fitted on the distal end portion 26 while the grip 28 is elastically deformed. Moreover, engagement of the distal ends of the cut-and-bent claws 52 with the rear ends of the retaining holes 56 satisfactorily prevents coming off of the grip 28. Each of the cut-and-bent claws 52 corresponds to the retaining claw.

The grip 28 is formed by a semi-cylindrical (U-shaped section) seal member 72 in which a part of the insertion hole 70 is formed and which closely contacts the lower half of the distal end portion 26, a semi-cylindrical (U-shaped section) surface member 74 that is disposed on the outer periphery of the seal member 72, and a grip body 78 having a semi-cylindrical portion 76 in which a part of the insertion hole 70 is formed and which closely contacts the upper half of the distal end portion 26. A pair of annular portions 80 arc provided at both ends in the axial direction of the grip body 78 so as to integrally cover and hold the ends of the seal member 72 and the surface member 74. Each of the seal member 72, the surface member 74, and the grip body 78 is made of a thermoplastic resin such as polyvinyl chloride. The seal member 72, the surface member 74, and the grip body 78 may be made of the same resin material. In the present embodiment, however, different resin materials are used for the seal member 72, the surface member 74, and the grip body 78 according to their functions. The grip body 78 corresponds to the outer cylinder body.

A space portion 82 having an arc shape extending in the circumferential direction of the insertion hole 70 is provided between a curved portion **72*r* of the seal, member 72 and a curved portion 74*r* of the surface member 74 so as to extend in the axial direction of the grip 28. Multiple elastic protrusions 84 are integrally and dispersedly formed on an inner peripheral surface 74*f* of the surface member 74 which is an outer peripheral-side wall surface of the space portion 82. The space portion 82 extends substantially along the entire length in the longitudinal direction of the seal member 72**.

The elastic protrusions 84 are formed so as to be substantially uniformly distributed substantially over the entire inner peripheral surface **74*f* forming the space portion 82. Tip ends of the multiple elastic protrusions 84 contact an outer peripheral surface 72*f* of the seal member 72 which is an inner peripheral-side wall surface of the space portion 82. The curved portion 74*r* of the surface member 74 which forms the space portion 82 is a portion which is exposed to the outside from the grip body 78 and on which a driver places his/her fingers when pulling up the parking brake lever 16. When a brake operation force is applied to the curved portion 74*r*, the multiple elastic protrusions 84 are pressed against the outer peripheral surface 72*f*** and are elastically deformed.

Figure 5:
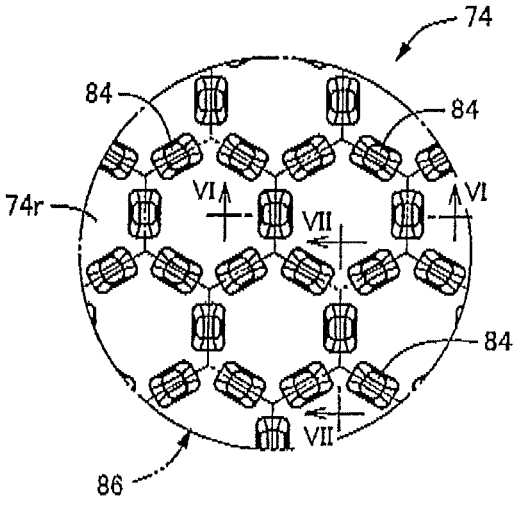
FIG. 5 is an enlarged plan view as viewed in the direction perpendicular to an inner peripheral surface of a curved portion of a surface member included in the grip of FIG. 3, illustrating multiple elastic protrusions formed on the surface member.
Figure 6:
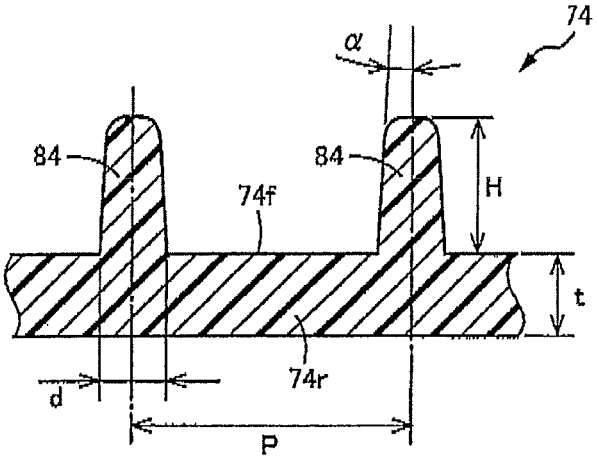
FIG. 6 is an enlarged longitudinal section taken along line VI-VI in FIG. 5.
Figure 7:
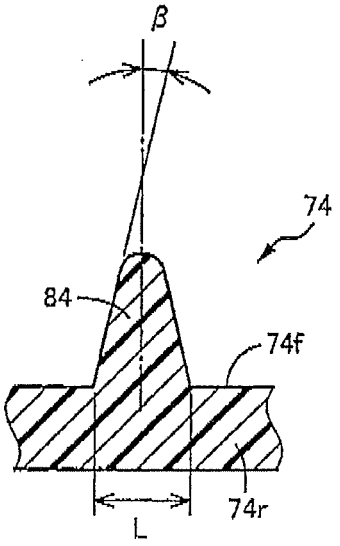
FIG. 7 is an enlarged longitudinal section taken along line VII-VII in FIG. 5.

FIG. 5 is an enlarged plan view as viewed in the direction perpendicular to the inner peripheral surface **74*f*, illustrating the multiple elastic protrusions 84 formed on the inner peripheral surface 74*f* of the curved portion 74*r* of the surface member 74. FIG. 6 is an enlarged longitudinal section taken along line VI-VI in FIG. 5, and FIG. 7 is an enlarged longitudinal section taken along line VII-VII in FIG. 5. As can be seen from these figures, the multiple elastic protrusions 84 have the same shape. The elastic protrusions 84 have an elongated shape (in the present embodiment, a rectangular shape) in plan as viewed in the direction perpendicular to the inner peripheral surface 74*f* (in the state of FIG. 5). The elastic protrusions 84 are arranged in a grid pattern 86 in which adjoining ones of multiple polygons (triangles, quadrilaterals, hexagons, etc.) of the same shape have a common side, and are positioned so as to form each side of the polygons. In the present embodiment, the elastic protrusions 84 have a rectangular shape with four rounded corners as viewed in plan, and are disposed in such an attitude that longitudinal directions of the elastic protrusions 84 match the sides of the polygons. As shown by long dashed double-short dashed lines in FIG. 5, the grid pattern 86 is a honeycomb pattern formed by a continuous repetition of regular hexagons of the same size as the polygons. The elastic protrusions 84** are provided one by one in the central portion of each side of the regular hexagons.

As can be seen from FIGS. 6 and 7, each elastic protrusion 84 has such a gently tapered shape that its sectional area decreases toward the tip end. Each of the longitudinal section of FIG. 6 taken along the lateral direction perpendicular to the longitudinal direction and the longitudinal section of FIG. 7 taken along the longitudinal direction has a symmetrical shape with respect to a neutral plane perpendicular to the inner peripheral surface 74*f*, and the peripheral edges of the tip end (both ends of the sectional shape) are rounded. The elastic protrusions 84 will be described in more detail below. A pitch P, which is an interval between two parallel sides of the regular hexagon in the grid pattern 86, namely the distance between the centers of the elastic protrusions 84 provided on the two sides, is in a range of 4 mm≤P≤7 mm. The height dimension H of the elastic protrusion 84 is in a range of 2 mm≤H≤3.5 mm. The lateral dimension d of the elastic protrusion 84 is in a range of 1 mm≤d≤2 mm. The longitudinal dimension L of the elastic protrusion 84 is in a range of 1.5 mm≤L≤2.5 mm and is larger than the lateral dimension d. The tilt angle α of the sidewalls on both sides in the lateral direction of the elastic protrusion 84 is in a range of 2°≤α≤5°. The tilt angle β of both edges in the longitudinal direction of the elastic protrusion 84 is in a range of 10° to 15°. The thickness t of the curved portion 74*r* of the surface member 74 having the elastic protrusions 84 formed thereon is in a range of 1 mm≤t≤2 mm. These dimensions and angles are determined as appropriate so as to achieve a predetermined feel (a soft feel etc.), strength, etc. in view of material of the surface member 74 etc.

Figure 8A:
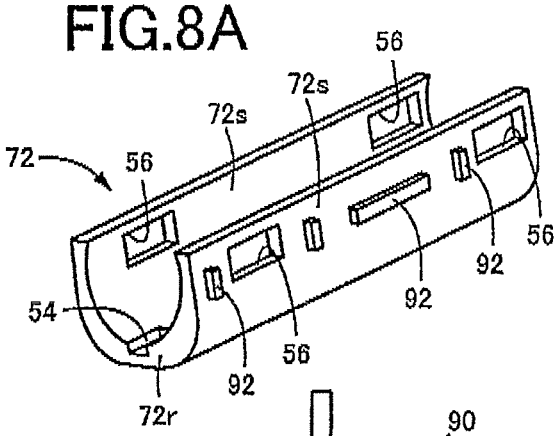
FIG. 8 are perspective views showing only the seal member in FIG. 8(*a*) and only the surface member in FIG. 8(*b*), and the seal member and surface member forming the grip of FIG. 2.
Figure 8B:
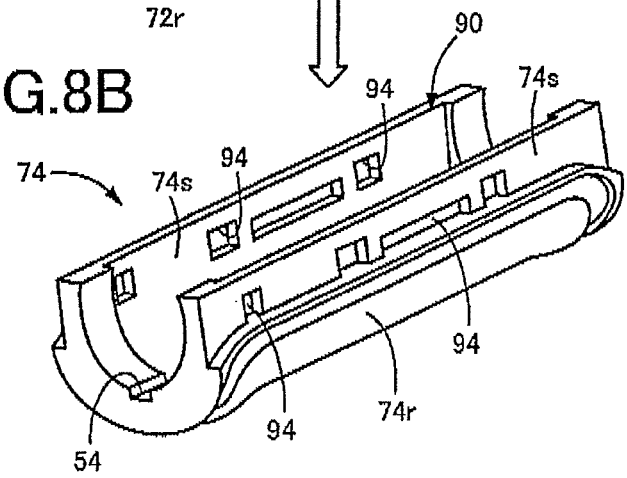
Figure 9:
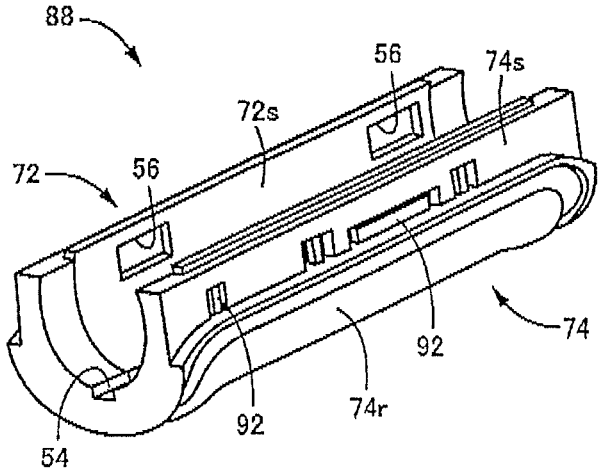
FIG. 9 is a perspective view showing a composite body in which the seal member is combined with the surface member in FIG. 8.

FIG. 8(*a*) is a perspective view showing only the seal member 72, and FIG. 8(*b*) is a perspective view showing only the surface member 74. After the seal member 72 and the surface member 74 are separately molded by injection molding etc., the seal member 72 is combined with the surface member 74 by fitting the seal member 72 in the surface member 74. A composite body 88 shown in FIG. 9 is thus produced. An inner peripheral surface of the semi-cylindrical seal member 72 forms a part of the insertion hole 70. The retaining holes 56 are formed in a pair of side portions 72*s* so as to extend therethrough, and the engagement grooves 54 and the protruding portions 60 are formed on the inner peripheral surface of the curved portion 72*r*. A fitting recess 90 in which the seal member 72 is to be fitted is formed in the semi-cylindrical surface member 74, and the engagement grooves 54 are formed in both ends in the axial direction of the surface member 74. The outer side surfaces of the pair of side portions 72*s* of the seal member 72 and the inner wall surfaces of the fitting recess 90 in a pair of side portions 74*s* of the surface member 74 are flat surfaces substantially parallel to each other so that the outer side surfaces of the pair of side portions 72*s* closely contact the corresponding inner wall surfaces of the fitting recess 90 by surface contact. A plurality of engagement protrusions 92 are formed on the outer side surfaces of the side portions 72*s*. By engaging the engagement protrusions 92 with engagement holes 94 formed in the side portions 74*s* so as to extend therethrough, the seal member 72 and the surface member 74 are combined with each other and kept in the assembled state shown in FIG. 9, namely in the state of the composite body 88. The seal member 72 and the surface member 74 are elastically deformable, and can be combined by fitting the seal member 72 into the surface member 74 by elastic deformation of the side portions 72*s*, 74*s* so as to engage the engagement protrusions 92 with the engagement holes 94. Although the multiple elastic protrusions 84 are formed on the inner peripheral surface 741 of the curved portion 74*r* of the surface member 74, these elastic protrusions 84 are not shown in FIG. 8(*b*).

Figure 10A:
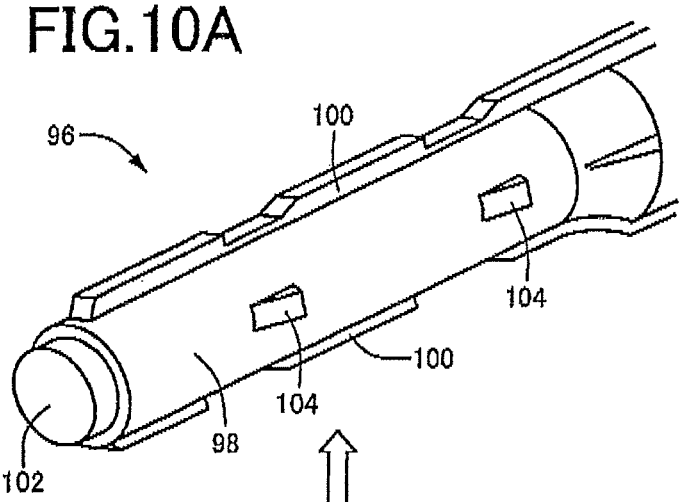
FIG. 10 are perspective views showing only a core in FIG. 10(*a*) and only the composite body of FIG. 9 in FIG. 10(*b*), which are used when the composite body is set on the core to insert-mold an outer cylinder body.
Figure 10B:
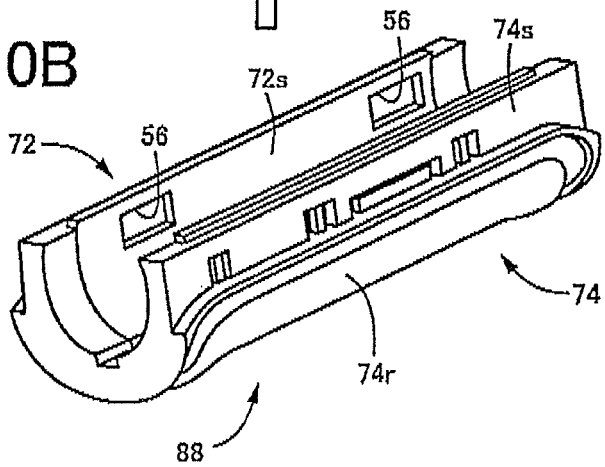
Figure 11:
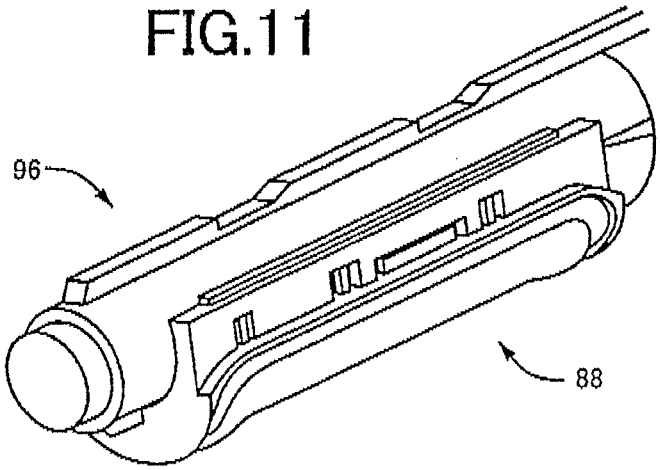
FIG. 11 is a perspective view of a state in which the composite body is set on the core in FIG. 10.

The composite body 88 is set on a core 96 as shown in FIGS. 10 and 11 and placed in a mold to insert-mold the grip body 78. The core 96 has a shape corresponding to the distal end portion 26 of the lever body 18, and a columnar body portion 98 has protrusions 100 corresponding to the flanges 50 having the cutouts 58, a columnar protruding portion 102 corresponding to the insertion hole 29, engagement protrusions 104 corresponding to the cut-and-bent claws 52, etc. The engagement protrusions 104 are engaged with the retaining holes 56 of the seal member 72, and the composite body 88 is set on the core 96 via the seal member 72 and placed in the mold, not shown. The grip body 78 having the engagement grooves 54, the protruding portions 60, the insertion hole 29, and the annular portions 80 is thus molded so as to be fixedly fitted on the composite body 88, and the composite body 88 is kept in the combined state by the grip body 78. Both ends in the longitudinal direction of the surface member 74 are covered by the annular portions 80, and the pair of side portions 74s having the engagement holes 94 in which the engagement protrusions 92 are fitted are covered by a pair of side portions 77 extending downward from the semi-cylindrical portion 76, as can be seen from FIG. 4. The side portions 72s of the seal member 72 and the side portions 74s of the surface member 74 have a relatively large thickness, and the side portions 72s of the seal member 72 are fused and bonded to the side portions 74s of the surface member 74 by the heat of a molten resin when insert-molding of the grip body 78 is performed.

As described above, in the grip structure of the parking brake lever 16 of the present embodiment, the space portion 82 is provided along the insertion hole 70 in which the distal end portion 26 is inserted, and the multiple elastic protrusions 84 are dispersedly formed on the inner peripheral surface 74*f* of the surface member 74 serving as the outer peripheral-side wall surface of the space portion 82. When the grip 28 is held and pulled up, the elastic protrusions 84 are pressed against the outer peripheral surface 72*f* of the seal member 72 and elastically deformed. Accordingly, by appropriately determining the shape such as thickness and height or the arrangement, density, etc. of the elastic protrusions 84, a soft, excellent feel can be achieved without reducing material hardness of the grip 28, and reduction in wear resistance, stickiness, etc. can be avoided.

The grip 28 has the seal member 72 mounted in close contact with the distal end portion 26, and the surface member 74 disposed on the outer periphery of the seal member 72. The cut-and-bent claws 52 of the distal end portion 26 are retained in the retaining holes 56 of the seal member 72, whereby the grip 28 is fixedly fitted on the distal end portion 26, and is prevented from rotating and coming off. In this case, the seal member 72 can be adapted to various types of parking brake levers by merely changing the shape of the inner peripheral surface of the seal member 72 etc. according to the shape and dimensions of the distal end portion 26, and the same surface member 74 can be used for various types of parking brake levers. This can reduce manufacturing cost.

Since the surface member 74 on which the elastic protrusions 84 are formed and the seal member 72 that is provided so as to closely contact the distal end portion 26 are formed as separate members, different materials (kinds of synthetic resins) can be used for the surface member 74 and the seal member 72 according to their functions. This can appropriately improve a feel such as a soft feel while ensuring fixing strength of the grip 28 etc.

In the present embodiment, the engagement grooves 54 and the protruding portions 60 of the grip 28 are engaged with the flanges 50 and the cutouts 58 of the distal end portion 26. This engagement also prevents rotation and coming-off of the grip 28. The grip 28 may be fixedly attached to the distal end portion 26 with an adhesive etc. as necessary.

The grip body 78 is fixedly fitted on the composite body 88, which is a combination of the seal member 72 and the surface member 74, by insert-molding, whereby the composite body 88 is kept in the combined state. The grip 28 can thus be produced at low cost.

The use of the composite body 88 having a semi-cylindrical shape ensures excellent workability in setting the composite body 88 on the core 96 of the mold when insert-molding of the grip body 78 is performed. The seal member 72 is combined with the surface member 74 by engaging the engagement protrusions 92 formed on the side portions 72*s* of the seal member 72 with the engagement holes 94 formed in the side portions 74*s* of the surface member 74. The seal member 72 can therefore be easily combined with the surface member 74 by flexurally deforming the side portions 72*s* of the seal member 72 inward or flexurally deforming the side portions 74*s* of the surface member 74 outward, and the seal member 72 and the surface member 74 are satisfactorily kept in the combined state, namely in the state of the composite body 88. This improves workability in insert-molding of the grip body 78.

The seal member 72 and the surface member 74 are combined such that the side portions 72*s* closely contact the side portions 74*s* by surface contact. This prevents the molten resin from entering the space portion 82 through a gap between the side portions 72*s*, 74*s* when insert-molding of the grip body 78 is performed.

The grip 28 is mounted on the distal end portion 26 such that the space portion 82 is located on a vehicle lower side, namely the side on which fingers of a driver are placed and to which a parking operation force is applied. This can locally improve a feel of a region on which the figures are placed while ensuring the rigid feel of the overall grip.

Grip strength may be ensured by forming a protruding or recessed shape in the lower part of the distal end portion 26 of the lever body 18 and fitting this protruding or recessed shape in or on a recessed or protruding shape formed in the grip 28. In the present embodiment, since the grip 28 includes the seal member 72, a protruding or recessed shape can be formed in the inner peripheral surface of the curved portion 72*r* of the seal member 72. The grip strength can thus be ensured in a manner similar to that of conventional examples without affecting the soft feel provided by the multiple elastic protrusions 84. The grip strength may also be ensured by fixedly attaching the grip 28 to the distal end portion 26 with an adhesive. In this case as well, the seal member 72 can be fixedly attached to the distal end portion 26.

Other embodiments of the present invention will be described below. In the following embodiments, substantially the same portions as those of the above embodiment are denoted with the same reference characters, and detailed description thereof will be omitted.

FIGS. 12 to 16 are sectional views corresponding to FIG. 4. In a grip 110 of FIG. 12, a seal member 112 has a cylindrical shape with a closed section, and a grip body 114 is provided on the outer periphery of the seal member 112.

Figure 13:
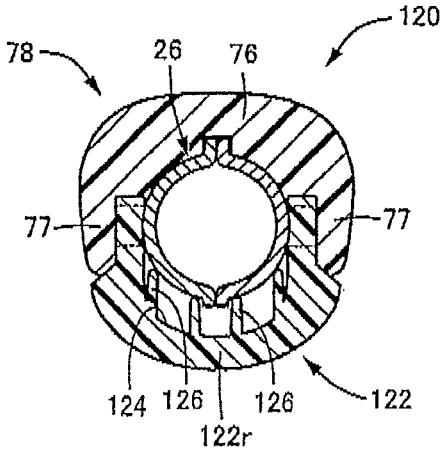
FIG. 13 is a sectional view of a further grip of the present invention, and is corresponding to FIG. 4.

In a grip 120 of FIG. 13, a recess 124 is formed in an inner peripheral surface of a curved portion 122*r* of a surface member 122 so that a space portion is formed between the curved portion 122*r* and the distal end portion 26 of the lever body 18. Multiple elastic protrusions 126 are formed in the recess 124 so as to extend to an outer peripheral surface of the distal end portion 26, and the seal member 72 is omitted. The multiple elastic protrusions 126 are pressed against the outer peripheral surface of the distal end portion 26 functioning as the inner peripheral-side wall surface of the space portion and are elastically deformed. In this case, the seal member 72 is not required. The number of parts is thus reduced, and the structure is simplified, whereby the grip 120 is produced at low cost.

Figure 12:
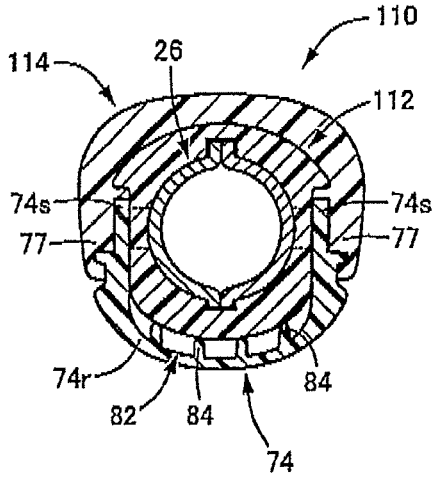
FIG. 12 is a sectional view of another grip of the present invention, and is corresponding to FIG. 4.
Figure 14:
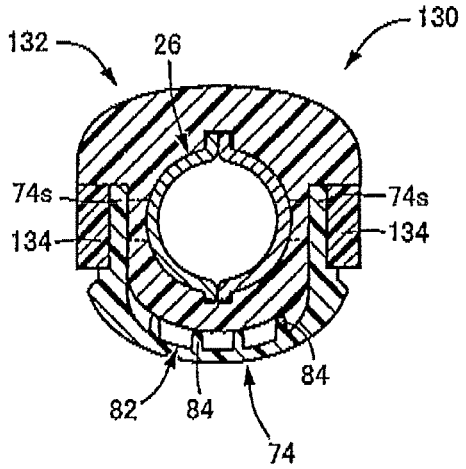
FIG. 14 is a sectional view of a still further grip of the present invention, and is corresponding to FIG. 4.

A grip 130 of FIG. 14 has a seal member 132 having a cylindrical shape with a closed section like the grip 110 of FIG. 12. However, the grip body 114 is omitted, and a pair of fused members 134 are integrally formed in both side portions by insert-molding. The side portions 74*s* of the surface member 74 are fused and fixed to the side surfaces of the seal member 132 by the heat in insert-molding. Since the grip body 114 is omitted, the shapes etc. of the seal member 132 and the surface member 74 are changed so that the grip 130 has predetermined appearance.

Figure 15:
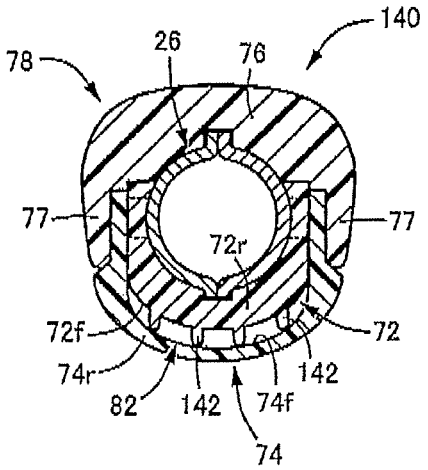
FIG. 15 is a sectional view of a yet further grip of the present invention, and is corresponding to FIG. 4.

A grip 140 of FIG. 15 is different from the grip 28 in that multiple elastic protrusions 142 are formed on the outer peripheral surface 72*f* of the curved portion 72*r* of the seal member 72 instead of forming the elastic protrusions 84 on the surface member 74. In the case of forming the elastic protrusions 84 on the surface member 74, sink marks (dimples) may appear on a surface of the surface member 74 depending on the shape of the protrusions and the thickness of the curved portion 74*r*. However, such sink marks do not appear on the surface in the case of forming the elastic protrusions 142 on the seal member 72. Elastic protrusions may be formed on the seal members 112, 132 in the grips 110, 130 of FIGS. 12, 14.

Figure 16:
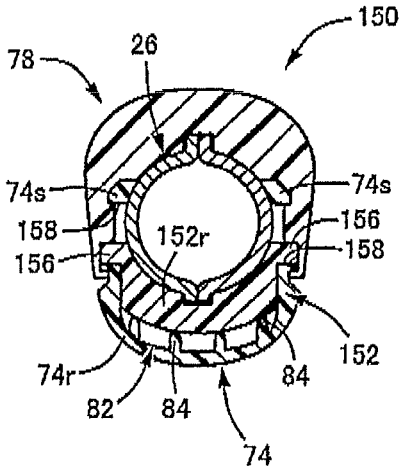
FIG. 16 is a sectional view of still another grip of the present invention, and is corresponding to FIG. 4.
Figure 17A:
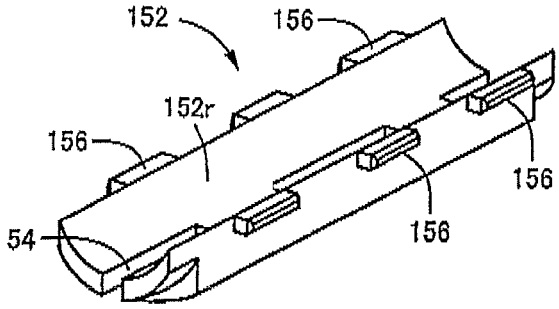
FIG. 17 are perspective views showing only the seal member in FIG. 17(*a*) and only the surface member in FIG. 17(*b*), the seal member and surface member forming the grip of FIG. 16.
Figure 17B:
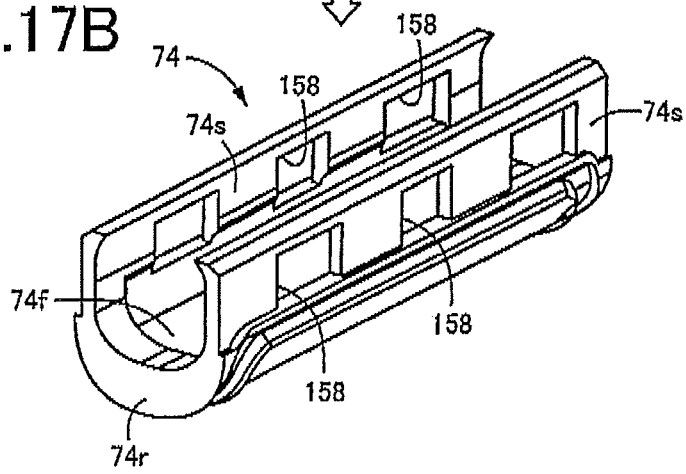
Figure 18:
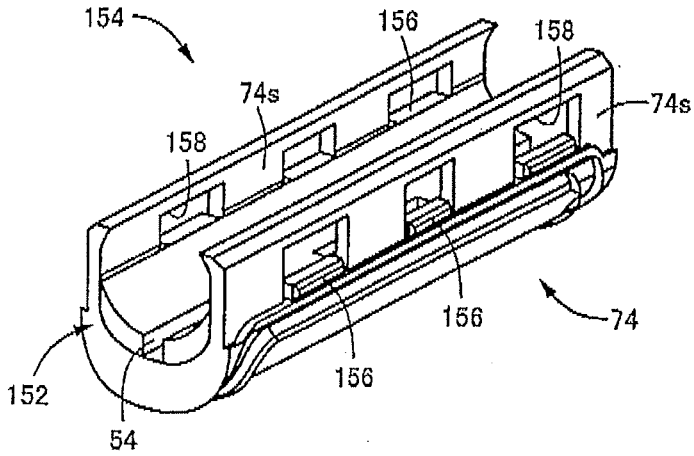
FIG. 18 is a perspective view showing a composite body in which the seal member is combined with the surface member in FIG. 17.

A grip 150 of FIG. 16 is different from the grip 28 in a seal member 152. The seal member 152 has a curved portion 152*r* similar to the curved portion 72*r*, but does not have the side portions 72*s*. The side portions 74*s* of the surface member 74 protrude upward beyond the seal member 152 and directly closely contact the outer peripheral surface of the distal end portion 26. FIG. 17(*a*) is a perspective view showing only the seal member 152, and FIG. 17(*b*) is a perspective view showing only the surface member 74. The seal member 152 is combined with the surface member 74 by fitting the seal member 152 in the surface member 74. A composite body 154 shown in FIG. 18 is thus obtained. A plurality of engagement protrusions 156 are formed on both side portions of the seal member 152 with an arc shape so as to protrude outward, and engagement holes 158 are formed in the side portions 74*s* of the surface member 74 so as to correspond to the engagement protrusions 156. By engaging the engagement protrusions 156 with the engagement holes 158, the seal member 152 and the surface member 74 are combined with each other and kept in the assembled state shown in FIG. 18, namely in the state of the composite body 154. The engagement holes 158 are slightly larger than the engagement protrusions 156 so that a predetermined clearance is provided above each engagement protrusion 156. When the grip body 78 is molded, the engagement protrusions 104 of the core 96 are retained in the clearances. When mounting the grip 150 on the distal end portion 26, the cut-and-bent claws 52 formed in the distal end portion 26 are retained in the clearances. That is, the engagement holes 158 function also as retaining holes in which the cut-and-bent claws 52 are retained. Although the multiple elastic protrusions 84 are formed on the inner peripheral surface 74*f* of the curved portion 74*r* of the surface member 74, the elastic protrusions 84 are not shown in FIG. 17(*b*).

This grip 150 also has functions and effects similar to those of the above embodiment. Since the seal member 152 has no side portion, and the side portions 74*s* of the surface member 74 directly closely contact the outer peripheral surface of the distal end portion 26, the thickness of the side portions of the grip 150 can be reduced, and design can be improved.

Although the embodiments of the present invention are described in detail based on the drawings, these embodiments are merely by way of example, and the present invention can be carried out in various modified or improved forms based on the knowledge of those skilled in the art.

NOMENCLATURE OF ELEMENTS

16: parking brake lever 18: lever body 26: distal end portion (holding portion) 28, 110, 120, 130, 140, 150: grip 52: cut-and-bent claw (retaining claw) 56: retaining hole 70: insertion hole 72, 112, 132, 152: seal member 72*f*: outer peripheral surface (inner peripheral-side wall surface) 74, 122: surface member 74*f*: inner peripheral surface (outer peripheral-side wall surface) 76: semi-cylindrical portion 78, 114: grip body (outer cylinder body) 82: space portion 84, 126, 142: elastic protrusions 88, 154: composite body 92, 156: engagement protrusions (protrusions) 94, 158: engagement holes (holes) 124: recess (space portion)

The invention claimed is:

1. A vehicle grip structure comprising a body member and a grip, wherein the body member is covered by the grip made of a synthetic resin, the grip comprises an insertion hole in which the body member is inserted and a space portion provided along the insertion hole, multiple elastic protrusions are formed integrally with the grip and dispersedly on one of an inner peripheral-side wall surface and an outer peripheral-side wall surface of the space portion so as to protrude toward the other wall surface, when the grip is held by a driver, the elastic protrusions are pressed against the other wall surface and elastically deformed, the elastic protrusions are arranged in a grid pattern in which adjoining ones of multiple polygons of the same shape have a common side, and being positioned so as to form each side of the polygons, the grip comprises a seal member in which at least a part of the insertion hole is formed and which is mounted so as to contact the body member, and a surface member that is disposed on an outer periphery of the seal member such that the space portion is formed between the surface member and the seal member, and a retaining claw formed in the body member is retained in a retaining hole formed in the seal member, whereby the grip is integrally mounted on the body member.

2. The vehicle grip structure according to claim 1, wherein the grip has an outer cylinder body that is fixedly fitted on a composite body as a combination of the seal member and the surface member by insert-molding, and that keeps the composite body in a combined state.

3. The vehicle grip structure according to claim 2, wherein the composite body has a semi-cylindrical shape, is formed by combining the seal member with the surface member by engaging, in both side portions of the semi-cylindrical shape, protrusions formed on one of the seal member and the surface member with holes formed in the other member, and has the space portion in a curved portion between the side portions, the outer cylinder body has a semi-cylindrical portion that together with the semi-cylindrical composite body forms the insertion hole, and a portion on an opposite side of the body member from the composite body is covered by the semi-cylindrical portion.

4. The vehicle grip structure according to claim 3, wherein in the composite body, the seal member and the surface member are combined so as to surface contact each other in the side portions.

5. The vehicle grip structure according to claim 1, wherein the body member is a holding portion of a vehicle parking brake lever, and the grip is mounted on the holding portion such that the space portion is located on a vehicle lower side or on a vehicle front side of the holding portion.

* * * * *